United States Patent [19]

Geary

[11] 4,177,764

[45] Dec. 11, 1979

[54] ANIMAL LEG CLAMP APPARATUS

[76] Inventor: William R. C. Geary, F.4/18 Kensington Rd., South Yarra, Victoria, Australia, 3141

[21] Appl. No.: 814,799

[22] Filed: Jul. 11, 1977

[51] Int. Cl.[2] ..... A61D 3/00

[52] U.S. Cl. ..... 119/103

[58] Field of Search ..... 119/103, 98, 151; 269/32, 228

[56] References Cited

U.S. PATENT DOCUMENTS

| | | | |
|---|---|---|---|
| 941,543 | 11/1909 | Sistek et al. | 269/32 |
| 1,112,867 | 10/1914 | Taylor et al. | 119/151 |
| 2,829,622 | 4/1958 | Borthwick | 119/103 |
| 3,215,120 | 11/1965 | Geary | 119/98 |

*Primary Examiner*—Hugh R. Chamblee
*Attorney, Agent, or Firm*—Holman & Stern

[57] ABSTRACT

This invention relates to clamps for attachment to the legs of animals, especially sheep, and among other things may be used for suspending the animals by their four legs for shearing and other treatment operations.

A clamp according to the invention comprises two pivotally connected clamp members between which the leg is clamped. The clamp is normally maintained in its open condition by at least one return spring, and is closed, in opposition to the spring or springs, by means actuated by a fluid under pressure.

Preferably the clamp, is normally locked or retained in its open condition so that it cannot be closed by the said fluid pressure means until it is released by operation of an actuating member.

One of the said clamp members is preferably fixed to a clamp carrier member, in which case the other or pivoted clamp member is opened and closed by the said spring and fluid pressure means respectively.

The said fluid pressure means preferably comprises a cylinder fitted with a slidable plunger and means for transmitting projecting movements of the plunger to the pivoted clamp member. When the pivoted clamp member is fully open, the line of action of the force transmitted thereto by the plunger preferably passes through or close to its pivotal axis, so that the closing torque, if any, thus transmitted to the pivoted clamp member is insufficient to overcome the opposing action of the return spring, while the said actuating member preferably imparts an initial closing movement to the pivoted clamp member.

The said cylinder is preferably connected by a tube to a master cylinder fitted with a spring-loaded piston by which the hydraulic fluid is normally maintained under pressure and means are provided for retracting the piston in order to relieve the pressure on the fluid and thus permit the clamp, when closed, to be re-opened by the return spring.

8 Claims, 10 Drawing Figures

ANIMAL LEG CLAMP APPARATUS

This invention relates to leg clamp apparatus suitable among other things for use in suspending sheep or other animals or for restraining the leg movements of animals otherwise supported.

Apparatus for suspending animals, especially sheep, in the inverted condition by means of leg clamps, thereby to facilitate the performance of shearing and other treatment operations, has previously been disclosed. Such apparatus comprises two longitudinally spaces pairs of transversely opposed clamps mounted on suitable supports, each such clamp being engageable with the corresponding leg of the inverted animal. This apparatus preferably also includes means whereby the said transverse pairs of clamps may be moved toward and from each other in order that the suspended animal may be arranged in different attitudes.

The present invention relates to improvements in leg clamps suitable, among other things, for use in apparatus of this kind.

Accordingly the invention includes leg clamp apparatus comprising an opposed pair of pivotally connected clamp members, carrier means therefor, at least one return spring by which the clamp is normally maintained in its open condition, and means operable by fluid pressure for closing the clamp in opposition to the return spring.

Preferably one of said clamp members is fixed to the carrier means in which case the clamp is opened and closed by actuation of the other clamp member, hereinafter termed the pivoted clamp member, by said return spring and said fluid pressure operable means respectively.

The apparatus also preferably includes means whereby the pivoted clamp member is locked or retained in its open position consequent upon its return thereto, and actuating means operable to release said locking or retaining means and thereby permit the clamp to be reclosed by said fluid pressure operable means.

More particularly said fluid pressure operable means preferably comprises a plunger slidably mounted in a cylinder, which in use, is connected to a reservoir of hydraulic fluid, and means for transmitting motion from the plunger to the pivoted clamp member thereby to force it to its closed position in opposition to the said spring, and wherein the line of action of the force thus transmitted to the pivoted clamp member, when the latter is in its open position, passes through, or close to, its pivotal axis whereby said pivoted member is retained in its open position by the return spring.

The said actuating means preferably comprises an arm fixed to the pivoted clamp member so that an initial closing movement may be imparted thereto by the said arm, thereby to permit the plunger to force the pivoted member to its closed position. The actuating arm is preferably so arranged that it is displaced by the leg of the animal as it is pushed sidewise into the open clamp which thus is automatically closed consequent upon the entry of the leg into the clamp.

Hydraulid fluid under pressure is preferably supplied to the clamp cylinder from a master cylinder or other reservoir in which is it normally maintained under pressure by a spring-loaded piston and means are preferably provided for retracting this piston in opposition to its spring, thereby to relieve the pressure on the fluid and so permit the clamp return spring to move the pivoted clamp member to its open position in which it is automatically locked or retained as previously described. The hydraulic fluid may then be pressurised again by the release of the retracted spring-loaded piston, as the clamp cannot be re-closed until the aforesaid initial closing movement is imparted to the pivoted clamp member by the actuating arm.

When it is desired that a plurality of leg clamps, say two or four, shall open substantially simultaneously, the cylinders of the several clamps may be connected to a common master cylinder.

In order however, that the invention may be more clearly understood representative forms of leg clamp apparatus in accordance therewith are move fully described below with reference to the accompanying drawings in which:

FIG. 1 is a diagrammatic view in elevation of apparatus for suspending inverted animals, FIG. 2 is a view in side elevation of one form of leg clamp apparatus, in accordance with the invention, the clamp being shown in the closed condition, FIG. 3 is a view in sectional side elevation of the apparatus shown in FIG. 2, FIG. 4 is a view in plan taken in the direction of the arrow 'A' in FIG. 2 and is partly a section taken on the line 4—4 thereof, FIG. 5 is a view similar to FIG. 4 and shows the clamp fully open FIG. 6 is a view, generally similar to FIG. 5, and is partly a section taken on the line 6—6 of FIG. 2, FIG. 7 is a view in sectional end elevation taken on the line 7—7 of FIG. 3

Figure 1:
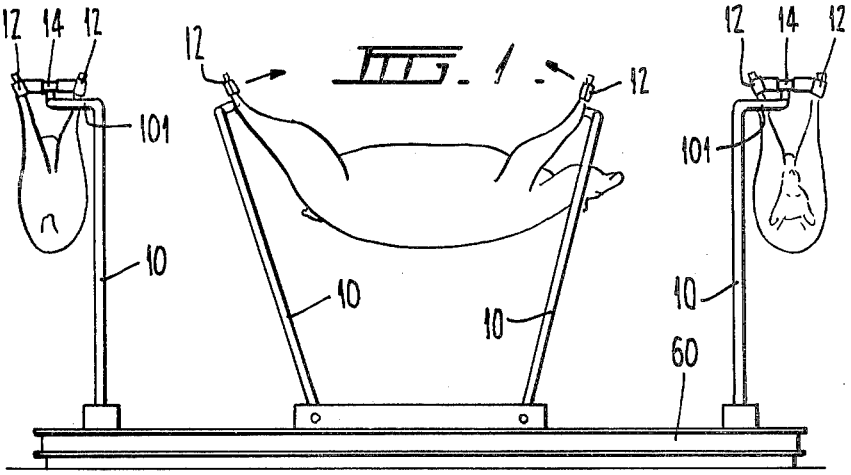
Figure 2:
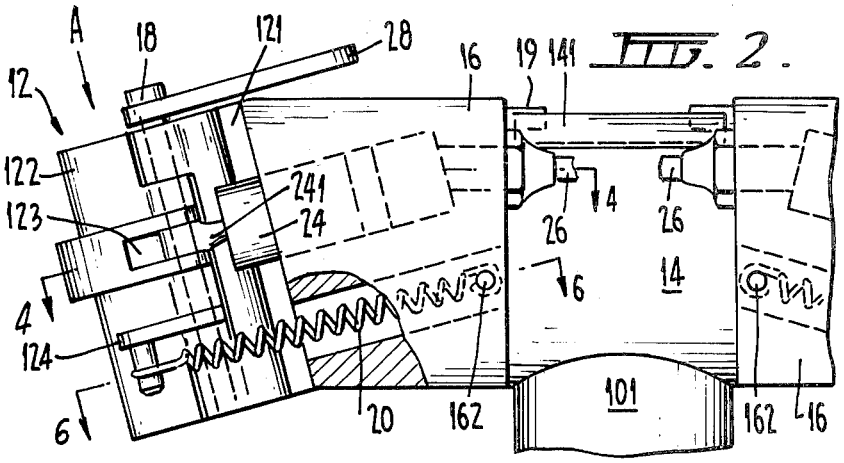

FIG. 1 diagrammatically shows apparatus for supporting sheep for shearing and other purposes and comprises a circular turntable 60 provided near its periphery with a plurality of, in this case four, equally spaced animal suspension assemblies. Each of these assemblies comprises a spaced pair of upstanding davit-like arms 10 each having its lower end pivoted to the turntable and provided at its upper end with an outward lateral extension 101 which supports a spaced pair of leg clamps 12. Thus an inverted animal may be suspended by its four legs from each of the suspension assemblies, as shown, and means are provided for swinging the arms 10 of each assembly towards and from each other in unison, so that the suspended animal may be arranged in the illustrated stretched out condition, while when the opposed arms are swung inwardly towards each other the animal is in the so-called "balled" condition.

Leg clamps according to the present invention are hereafter described as applied to suspension means of the aforesaid kind though it is to be understood that they are equally suitable for use in other suspension apparatus and also for other purposes.

Referring now to FIGS. 2 to 6, the reference numeral 101 designates the aforesaid lateral extension at the upper end of a pivoted davit arm, this extension being rigidly connected to, a clamp support member 14.

Two horizontal coaxially arranged tubular spindles 15, having interfitting inner ends are mounted in the support member 14 so as to be angularly movable therein, the said interfitting ends being so formed that the spindles are constrained in turn in unison but are separable by moving them apart axially, though this is normally prevented by a centrally arranged tie bolt 17.

Figure 3:
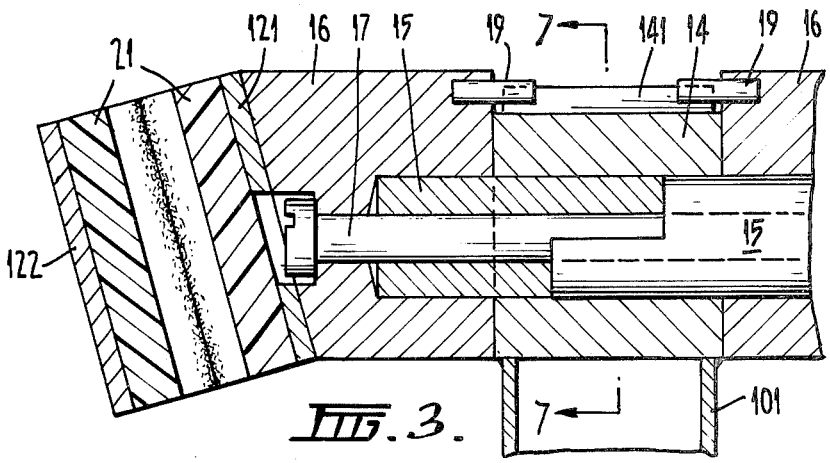
Figure 7:
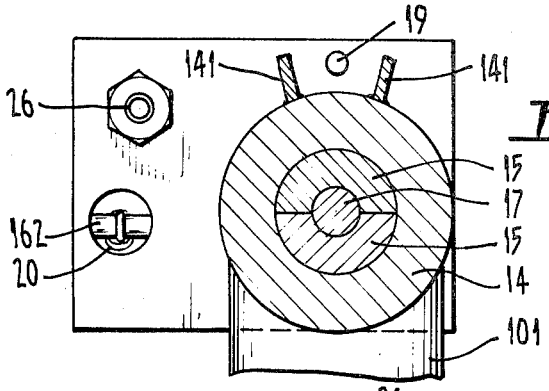
Figure 8:
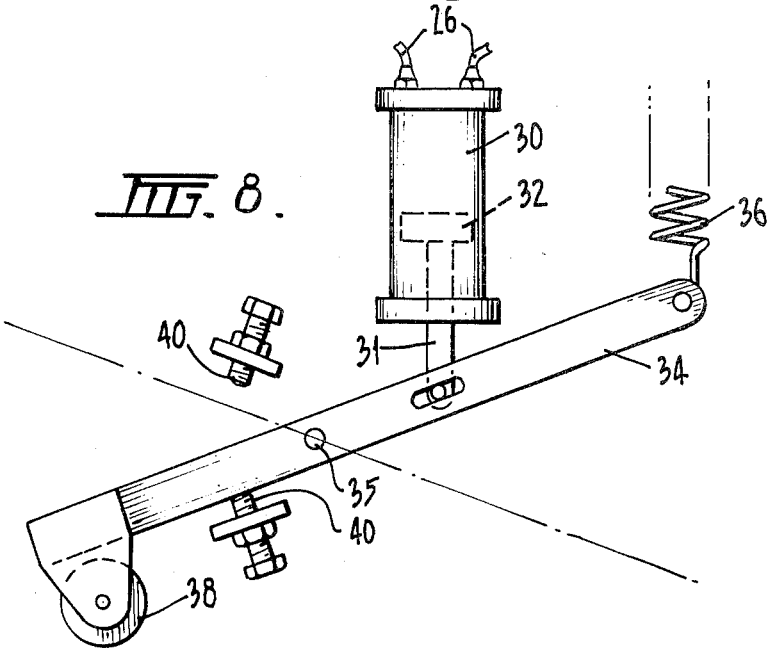
FIG. 8 is a view in plan of a master cylinder and associated mechanism

A carrier member 16 for a corresponding leg clamp 12, is secured to the projecting outer end of each spindle 15 and angular movements of the latter are limited by stop pins 19 which project inwardly from the respective carrier members 16 into the space between two angularly arranged lugs 141 on the support member 14 as shown in FIGS. 3 and 7.

Thus the spindles 15 together with the respective clamps 12 are permitted to move angularly in unison through a limited distance in order to enable the clamps to align with the respective legs of a suspended animal as the opposed davit arms 10 are moved towards or from each other.

Each clamp 12 is generally tubular in form and comprises an inner clamp member 121 of arcuate form which is welded or otherwise secured to an inclined face on the outer end of the respective carrier 16, the inclination being such that when viewed from the side the two clamps incline downwardly and inwardly as shown in FIG. 3. A coacting clamp member 122 is pivotally connected by a pin 18 to the fixed member 121 and each clamp member has an internal lining 121 of suitable resilient material, such as foam or soft rubber, by which the leg of the animals may be firmly clamped without injury or discomfort.

Each pivoted clamp member 122 is continuously urged towards its open position by means of a tension spring 20 which is connected at its outer end to a lug 124 thereon, and at its inner end to an anchorage 162 on the respective carrier 16.

Figure 4:
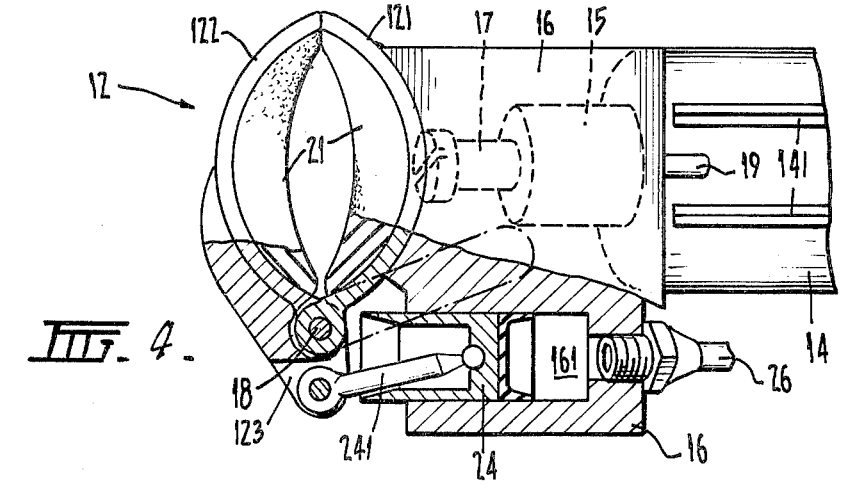

Each pivoted clamp member 122 is also provided with a further projecting lug 123 which is pivotally connected to the outer end of a connecting rod 241. The opposite end of this connecting rod has a spherical head seated in a socket in a slidable plunger 24 mounted in a cylinder 161 which is formed in the respective clamp carrier 16 and disposed at right angles to the plane of separation of the clamp member 121 and 122 as shown in FIG. 4. The plunger is suitably sealed to the cylinder such as by a leather cup as shown.

The closed inner end of the cylinder 161 is connected by a tube 26 to a master or supply cylinder 30, hereinafter described, containing a hydraulic fluid which is normally maintained under pressure by a spring loaded piston therein.

Figure 5:
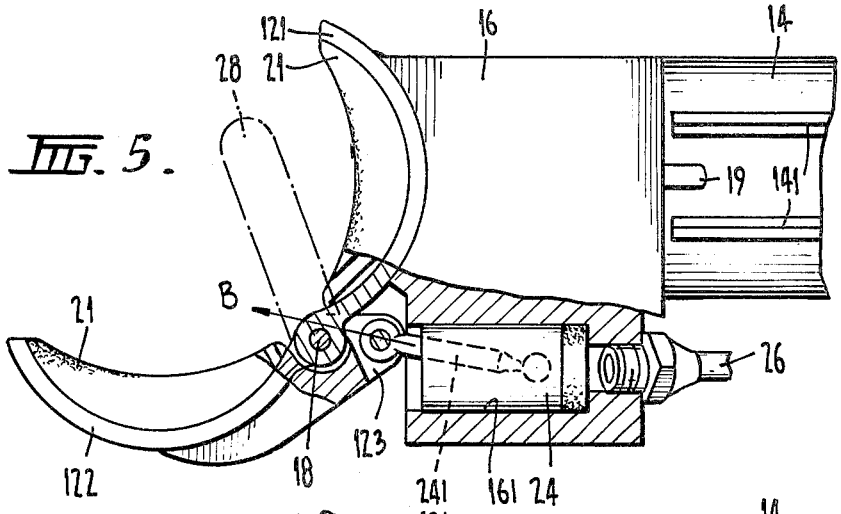

When the pivoted clamp member 122 is in its fully open position, as shown in FIG. 5, the axis of the connecting rod 241 when extended outwardly passes above the axis of the pivot pin 18 of the clamp member 122, as viewed in that Figure, so that the latter is locked in its open position in the sense that it cannot be closed by means of the plunger 24. Otherwise expressed when the clamp member 122 is in its fully open position, the line of action "B" of the force transmitted thereto by the plunger passes above the pivotal axis of the latter, as viewed in FIG. 5, and so tends to open it still further. It is however to be noted that if the said line of action passed through, or even below but close to, the pivotal axis, the clamp member 122 could not be closed by operation of the plunger, as this cannot occur until the said line of action moves so far below the pivotal axis that the closing torque exerted by the plunger is greater than the torque exerted in the opposite direction by the spring 20.

Thus before the clamp may be closed by the plunger 24, it is necessary to impart an initial closing movement to the pivoted clamp member 122 and this is effected by means of an actuating arm 28 secured thereto. For this purpose the actuating arm is secured to the projecting upper end of the pivot pin 18 which in turn is secured to the pivoted clamp member 122.

Figure 6:
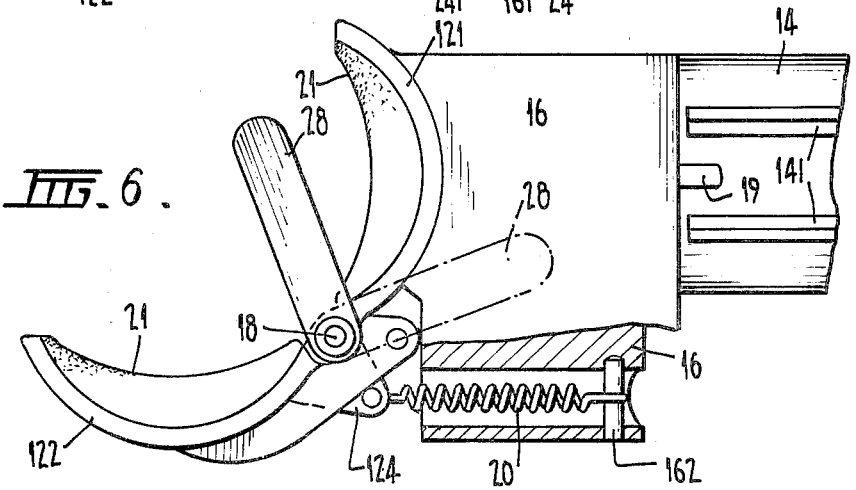

When the pivoted clamp member 122 is fully open, the actuating arm 28 projects outwardly above and beyond the fixed inner clamp member 121 as shown in FIG. 6. Thus when a sheep is supported in an inverted condition below the four open clamps of a suspension unit, each leg in turn may be pressed sidewise into the respective open clamp during which it will displace the actuating arm 28 and thus impart an initial closing movement to the pivoted clamp member 122. The angular movement thus imparted to the said clamp member is of a sufficient magnitude to enable the plunger, when under pressure, to close the clamp firmly in opposition to the tension of the return spring 20. When subsequently the pressure of the fluid in the cylinder 161 is relieved, as hereinafter described, the pivoted clamp member 122 is immediately returned to its fully open position by the spring 20.

Consequently the cylinder 161 of each of the four normally open clamps, required to suspend an animal by its four legs, may be connected by tubes 26 to a common master cylinder so that when the fluid in the latter is pressurised, each clamp may be automatically closed in turn by inserting the respective leg of the animal therein. When subsequently the shearing or other treatment of the animal has been completed, and the pressure of the hydraulic fluid is released, the four clamps reopen simultaneously and the animal drops therefrom for which purpose a suitable reverting device would be arranged therebelow to return it to its upright position. In the case of a rotary suspension apparatus of the kind shown in FIG. 1, this operation may be effected automatically at a discharge station.

From the foregoing description it will be understood that due to the aforesaid means for locking the pivoted clamp member in its fully open position it is not necessary to provide a control valve in the tube 26 which connects the clamp 161, to the master or supply cylinder.

One suitable type of master or supply cylinder 30 and associated mechanism is shown in FIG. 6. This cylinder is fitted with a piston 32, and a piston rod 31 secured thereto, has its outer end connected by a pin to one end portion of a rocker arm 34 at a suitable distance from a pin 35 by which the arm is mounted on a fixed support and the angular movements of the arm are limited by adjustable stops 40. The hydraulic fluid in the cylinder is normally maintained under pressure by means of a tension spring 36 connected to the rocker arm. Thus the pressure of the fluid may be relieved by turning the rocker arm in the opposite direction, i.e. clockwise in the Figure, thereby to retract the piston. For this purpose the opposite end portion of the rocker arm may, for example, be provided with a roller 38 for engagement by an actuating member, which in the case of rotary suspension apparatus of the kind shown in FIG. 1, may be an abutment located at a discharge station of the turntable.

Figure 9:
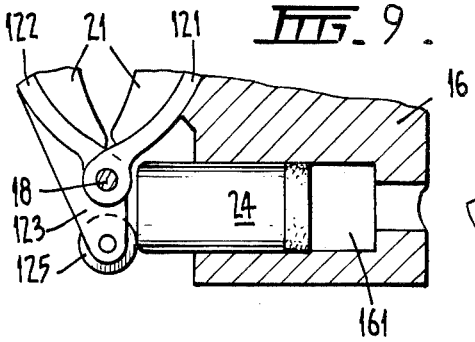
FIG. 9 is a detail view similar to FIG. 4 and shows a modification.
Figure 10:
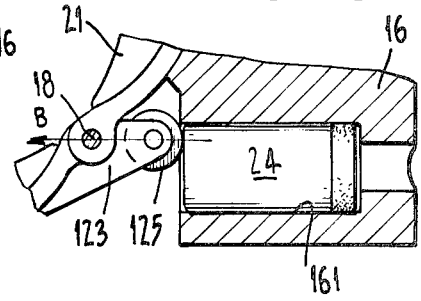
FIG. 10 is a view similar to FIG. 9 showing the clamp in its fully open condition.

In the modified clamp construction shown in FIGS. 9 and 10, the outer end of the plunger 24 in the cylinder 161 engages a roller 125 mounted on a lug 123 on the pivoted clamp member 122. This roller is so located that when this clamp member is in its fully open position, as shown in FIG. 10, the line of the action "B" of the force transmitted thereto by the plunger 24, passes through, or close to, the pivotal axis of the clamp member which is thus locked against displacement by the plunger until an initial closing movement of suitable magnitude is imparted to the clamp member as previously described.

While it is preferred to retain the pivoted clamp member 22 in its fully open position by the above described self-locking action of the clamp closing means, it will be apparent that various alternative locking means may be used for the same purpose. Thus for example, a spring-loaded pivoted catch arm may be provided to automatically engage the pivoted mould member as it reaches its fully open position thereby to prevent re-closure of the clamp until the catch arm is released manually or otherwise.

I claim:

1. Animal leg clamp apparatus comprising, a carrier, a fixed clamp member associated with said carrier, a coacting clamp member pivotally connected to said fixed clamp member for movement towards and from said fixed clamp member to close and open the clamp respectively, at least one return spring connecting said carrier to said coacting clamp member for normally maintaining said coacting clamp member in its open position, a hydraulic cylinder fixed relative to said carrier and which in use is connected to a fluid reservoir, a slidable plunger in the cylinder, and means for transmitting motion from the plunger to the coacting clamp member thereby to close the clamp in opposition to the return spring, and wherein, as said coacting clamp member closely approaches its fully open position, the line of action of said means for transmitting motion thereto passes over the pivotal axis thereof, thereby to lock said coacting clamp member in its open position, and actuating means operatively connected to the coacting clamp member for imparting initial closing movement to the coacting clamp member, thereby to permit the clamp to be re-closed by the plunger.

2. Animal leg clamp apparatus according to claim 1, wherein said actuating means comprises an arm fixed to the coacting clamp member, said arm when the clamp is open, being disposed in the path in which the animal's leg is moved towards the fixed clamp member, whereby said arm is displaced to impart said initial closing movement to the coacting clamp member.

3. Animal leg clamp apparatus according to claim 1, wherein said carrier is supported for angular movements about a transverse axis passing through the clamp, whereby the latter may align itself with a leg clamped thereto.

4. Animal leg clamp apparatus according to claim 1, including a support member and wherein said carrier is arranged at one side of said support member and is mounted thereon for angular movements about a horizontal axis which passes approximately centrally through the clamp, and wherein the clamp support member includes a carrier of a second and similar leg clamp similarly arranged and mounted at the opposite side of the support member for angular movements about the same horizontal axis.

5. Animal leg clamp apparatus according to claim 1, including means operable to subject the fluid in the reservoir to pressure and means operable to relieve the pressure therein whereby when the clamp is closed and the pressure within the reservoir is relieved, the clamp is opened automatically by said return spring.

6. Animal leg clamp apparatus comprising, a carrier, a fixed clamp member associated with said carrier, a coacting clamp member pivotally connected to the fixed clamp member for movement towards and from the fixed clamp member to close and open the clamp respectively, at least one return spring interposed between the carrier and the coacting clamp member for normally maintaining the coacting clamp member in its open position, a hydraulic cylinder supported by the carrier which in use is connected to a fluid reservoir, a slidable plunger in the cylinder, and means for transmitting motion from the plunger to the coacting clamp member thereby to close the clamp in opposition to the return spring, and wherein, when said coacting clamp member is in its fully open position, the line of action of said means for transmitting motion thereto is disposed close to the pivotal axis thereof, and actuating means connected to the coacting clamp member for imparting an initial closing movement to the coacting clamp member, thereby to permit the clamp to be re-closed by said plunger.

7. Animal leg clamp apparatus comprising two longitudinally spaced support means, an opposed pair of transversely spaced leg clamp assemblies mounted on each support means by which an animal may be suspended in the inverted condition, wherein each clamp assembly comprises a carrier mounted on the respective support means, a fixed clamp member associated with the carrier, a coacting clamp member supported by the carrier for movement towards and from the fixed clamp member, thereby to close and open the clamp respectively, at least one spring connecting the coacting clamp member and the carrier and for normally retaining said coacting clamp member to its open position, hydraulic means supported by the carrier and operable to engage and close the coacting clamp in opposition to said spring, means operable to retain the coacting clamp member in its open position in opposition to said hydraulic means, and actuating means movably supported by the carrier and operable to release said retaining means thereby to permit the clamp to be closed, and including a hydraulic fluid reservoir, common to all clamp assemblies and in constant communication with each of said hydraulic means, means operable to subject the fluid in the reservoir to pressure, and means operable to relieve the pressure therein, whereby, after the clamp of each assembly has been independently closed and the pressure in the reservoir is relieved, and all clamps are opened substantially simultaneously by their respective return springs.

8. Animal leg clamp apparatus according to claim 7 wherein said actuating means of each assembly is operable to impart an initial closing movement to the respective movable clamp member.

* * * * *